United States Patent [19]

Carey

[11] Patent Number: 4,468,269

[45] Date of Patent: Aug. 28, 1984

[54] ULTRACENTRIFUGE ROTOR

[75] Inventor: Robert S. Carey, Menlo Park, Calif.

[73] Assignee: Beckman Instruments, Inc., Fullerton, Calif.

[21] Appl. No.: 345,782

[22] Filed: Mar. 28, 1973

[51] Int. Cl.[3] ..... B65N 81/00

[52] U.S. Cl. ..... 156/175; 156/180; 156/181; 156/330; D24/22

[58] Field of Search ..... 233/DIG. 1; 102/DIG. 4; 156/169, 182, 175, 180, 330, 181; D24/22

[56] References Cited

U.S. PATENT DOCUMENTS 3,363,479 1/1968 Pickels ..... 74/572

FOREIGN PATENT DOCUMENTS 87740 10/1957 Netherlands ..... 233/DIG. 1

*Primary Examiner*—Stephen J. Lechert, Jr.
*Attorney, Agent, or Firm*—R. J. Steinmeyer; F. L. Mehlhoff; W. H. May

[57] ABSTRACT

An ultracentrifuge rotor comprising a body portion formed as a bowl with a central open chamber defined by a thin, cylindrical wall extending from a supporting base and a plurality of nested rings of filament windings surrounding the cylindrical wall for strengthening and stiffening same. The nested rings result in a uniform filament density throughout the ring assembly.

19 Claims, 4 Drawing Figures

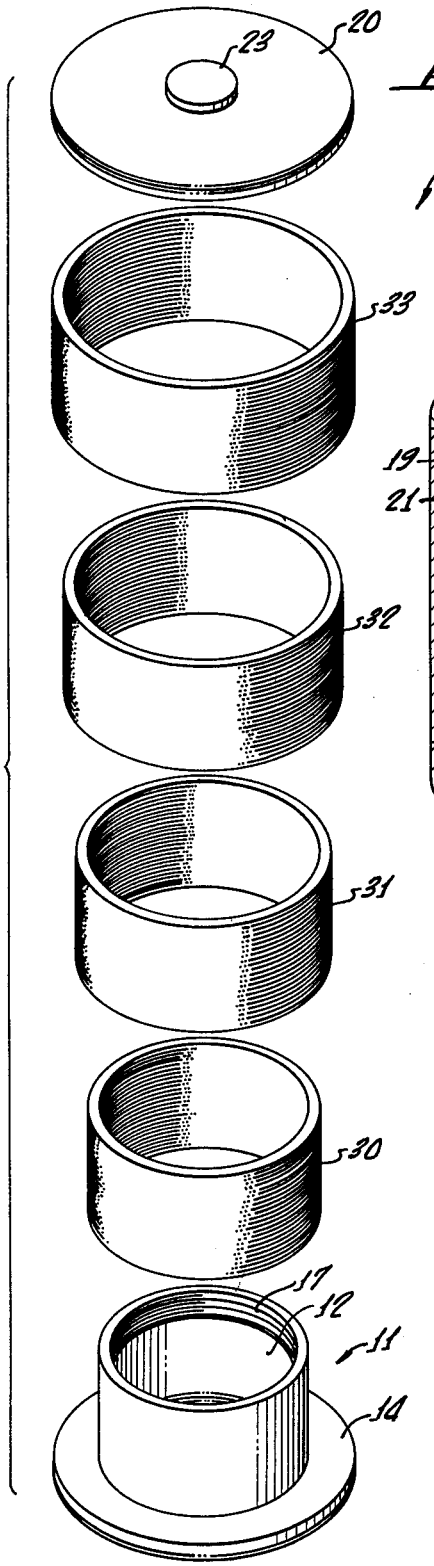
FIG. 2.
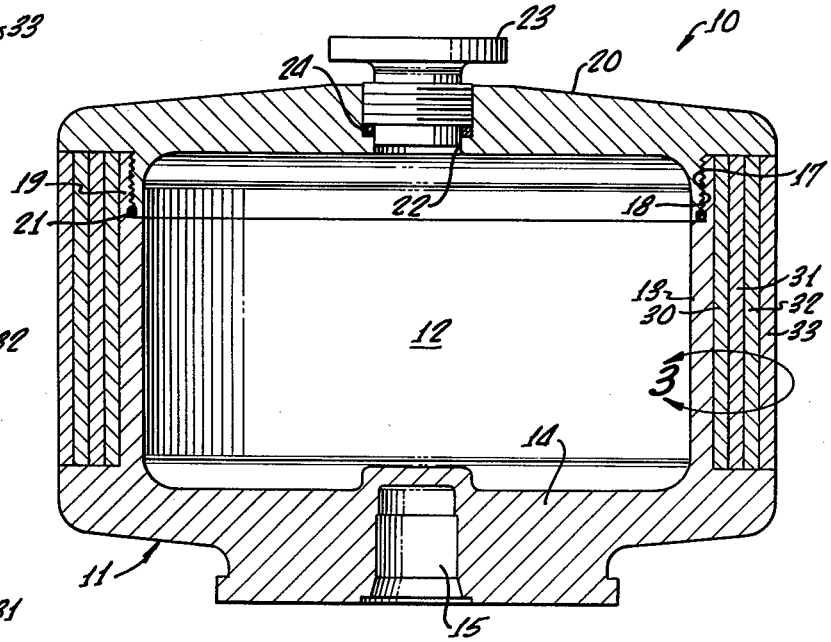
FIG. 1.
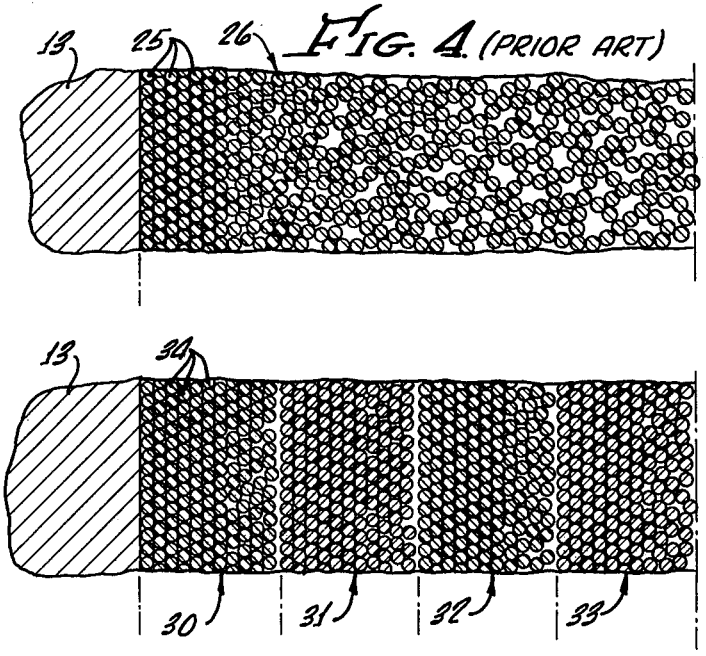
FIG. 4 (PRIOR ART)
FIG. 3.

ULTRACENTRIFUGE ROTOR

BACKGROUND OF THE INVENTION

1. Field of the Invention

The present invention relates to ultracentrifuge rotors and, more particularly, to a method and apparatus for increasing the speed and improving the "g" force operation of ultracentrifuge rotors.

2. Description of the Prior Art

Ultracentrifuge rotors are limited to a degree of centrifugal force at which they break down and disintegrate because of the high "g" forces. Therefore, in selecting materials for use in constructing ultracentrifuge rotors, important properties are high strength, high modulus, and low density. The strength-to-density ratio is important because the weight of the rotor itself contributes significantly to the stress forces thereon during operation. Common materials having relatively high strength-to-density ratios are aluminum, titanium, and heat treated steel.

It is also known to use filament windings of high strength, high modulus fibers, such as boron or carbon, in ring form, to strengthen and stiffen rotor structures and improve their performance. The ability of these fiber rings to support the tangential stresses is directly related to the filament density. To be useful for practical rotor designs, high filament density rings of thicknesses of ¼" and greater are needed. Furthermore, design analysis has shown that the tangential stresses increase from the inside to the outside diameter of such supporting rings. However, with fine fibers, it is difficult to maintain a consistent winding pattern for more than ten to twelve layers of fibers. As a result, rings used heretofore have a relatively high filament density at the inside diameter of the ring but a relatively low filament density at the outside diameter of the ring. The low filament density results in a lower specific modulus and strength as the ring thickness increases and this is opposite from the desired strength and modulus distribution.

SUMMARY OF THE INVENTION

In accordance with the present invention, these problems are solved by providing a rotor structure which is stiffened by a high filament density ring in which the filament density is as high at the outside diameter of the ring as it is at the inside diameter of the ring. With the present invention, fibers having diameters of less than 0.01" may be used to fabricate rings having thicknesses of ¼" and more.

Briefly, the present ultracentrifuge rotor comprises a body portion formed as a bowl with a central open chamber defined by a thin, cylindrical wall extending from a supporting base and a plurality of nested rings of filament windings surrounding the cylindrical wall to strengthen and stiffen same. The rings are fabricated in thin sections to achieve high filament densities and then nested together to give a high-performance thicker ring. The ring sections are wrapped or wound on mandrels having different diameters, the diameters being chosen so that each ring section will be ten to fifteen filament layers thick. The rings are nested together by coating with a thin coat of epoxy and then lightly pressing the rings onto each other using a very small axial loading pressure. The rings are assembled onto the cylindrical wall of the body portion in the same manner.

OBJECTS

It is therefore an object of the present invention to provide a novel ultracentrifuge rotor.

It is a further object of the present invention to provide apparatus for increasing the speed and improving the "g" force operation of ultracentrifuge rotors.

It is a still further object of the present invention to provide a method for fabricating an ultracentrifuge rotor having an improved "g" force operation.

It is another object of the present invention to provide an ultracentrifuge rotor comprising a body portion and a plurality of nested rings of filament windings surrounding the body portion.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is a cross-sectional view taken through the axis of rotation of an ultracentrifuge rotor constructed in accordance with the teachings of the present invention;

FIG. 2 is an exploded perspective view of the ultracentrifuge rotor of FIG. 1 showing the nested rings of filament windings;

FIG. 3 is a highly enlarged cross-sectional view of a portion of the rings of the ultracentrifuge rotor of FIG. 1, taken in the area of the line "3" in FIG. 1; and FIG. 4 is a cross-sectional view similar to that of FIG. 3 but showing the prior art filament density distribution obtainable heretofore.

DESCRIPTION OF THE PREFERRED EMBODIMENT

Referring now to the drawings and, more particularly, to FIGS. 1 and 2 thereof, there is shown an ultracentrifuge rotor, generally designated 10, constructed in accordance with the teachings of the present invention, and including a body portion, generally designated 11. Body portion 11 is formed as a bowl with a central open chamber 12 defined by a thin, cylindrical wall 13 extending from a supporting base 14. Base 14 includes a socket 15 which extends thereinto from the bottom thereof to receive the shaft of a drive motor, not shown. The outside diameter of base 14 is greater than the outside diameter of wall 13, for reasons which will appear more fully hereinafter.

Cylindrical wall 13 may be internally threaded, at 17, adjacent the top thereof, for receipt of the external threads 18 surrounding a short, cylindrical wall 19 extending from a cover 20. Thus, threads 17 on wall 13 engage threads 18 on wall 19 to enclose chamber 12 with cover 20. A conventional O-ring gasket 21 may be used between walls 13 and 19 to provide a fluid-tight arrangement between body portion 11 and cover 20. Finally, cover 20 may include an internally threaded, central opening 22 which may be sealed by an externally threaded cap 23 surrounded by an O-ring gasket 24. Thus, cap 23 provides access to chamber 12.

The particular construction of body portion 11 and cover 20 of ultracentrifuge rotor 10 has been included as being typical of available ultracentrifuge rotors and it is not intended that the teachings of the present invention shall be limited to rotors having such structures since other configurations are well known to those skilled in the art. Suffice it to say that whether aluminum, titanium, or heat treated steel is used to form wall 13, rotor 10 is limited to a degree of centrifugal force at which wall 13 will disintegrate because of the high "g" forces. Thus, it has been proposed to surround wall 13 with a ring of high strength, high modulus fibers, such as boron or carbon, to strengthen and stiffen wall 13 to thereby improve the performance and operating speed of rotor 10. A typical filament density distribution obtainable heretofore is shown in FIG. 4 where a series of fibers 25 are formed into a ring 26 and positioned around wall 13. However, and as shown in FIG. 4, with fine fibers, it is difficult to maintain a consistent winding pattern for more than ten to twelve layers of fibers. As a result, ring 26 has a relatively high filament density at the inside diameter thereof, adjacent wall 13, but a relatively low filament density at the outside diameter thereof. This results in a lower specific modulus and strength as the ring thickness increases. However, since the tangential stresses in ring 26 increase as the diameter increases, the strength and modulus distribution obtainable with ring 26 is opposite from the desired characteristics.

Referring now to FIGS. 1–3, ultracentrifuge rotor 10 comprises a plurality of rings 30–33 of filament windings which surround wall 13 of body portion 11 to strengthen and stiffen same. The total thickness of rings 30–33 is equal to the difference in radii between cover 20 and base 14 on the one hand and wall 13 on the other hand so that the outer diameter of ring 33 is equal to the outer diameter of cover 20 and base 14. Each of rings 30–33 is made up of filament-wound fibers 34 which are manufactured in a manner to be described hereinafter. Rings 30–33 are fabricated in thin sections to achieve high filament densities. This is shown most clearly in FIG. 3 where it is seen that limiting each ring section to ten to fifteen filament layers permits a consistent winding pattern, thereby providing a uniform filament density. Generally speaking, rings 30–33 are then nested together to provide a high performance thicker ring. After the rings are nested together and assembled onto wall 13, cover 20 may be secured to body portion 11 to provide a unitary structure.

Conventional techniques may be used to fabricate rotor 10. The individual ring sections 30–33 may be wrapped or wound on mandrels having different diameters, the diameters being chosen so that each ring section will be ten to fifteen filament layers thick. Fibers 34 are preferably made from boron or carbon and are precoated with a polymer and encased in an epoxy matrix. Suitable coating materials are polyamide, polyimidamide, epoxy, and phenolic. After pre-coating, the coated fibers may be wound to the desired shape, passing the filaments through a lacquer-type bath using the same materials mentioned above. Each ring structure is then thermally cured.

After each ring 30–33 is prepared, the rings are nested together to provide the configuration shown in FIG. 1. This may be achieved by coating each ring 30–33 with a thin coat of polymer or epoxy and lightly pressing them together, using very small axial loading pressures. The four assembled rings are then partially cured between 250° and 350° F. for times between two and four hours, depending on the polymer or epoxy that is used.

The nested rings are then assembled onto body portion 11 to provide the structure shown in FIG. 1. This may be achieved by coating wall 13 and the assembled rings with a thin coat of polymer or epoxy for lubrication purposes and lightly pressing the rings onto wall 13, using very small axial loading pressures. The final structure is then cured at similar temperatures and times as used for the assembled rings, again depending on the polymer or epoxy that is used.

With the present technique, fiber diameters less than 0.01" may be used to provide supporting rings having a total thickness of ¼" and more. By fabricating the rings in thin sections and then nesting the rings together, it is possible to achieve a uniform filament density so that the filament density is as high at the outside diameter of ring 33 as it is at the inside diameter of ring 30. This technique could also be used to fabricate rings having controlled but varying modulus and strength properties across a ring section, if this is desirable for better load distribution.

Tests made on individual ring sections and assembled rings as described herein have indicated a marked improvement over rings previously fabricated. Modulus values for the individual ring sections and assembled composite ring have exceeded 50,000,000 lbs./in.$^3$ where maximum values previously achieved were below 40,000,000 lbs./in.$^3$. Strength levels in excess of 250,000 lbs./in.$^2$ have also been measured in ring sections.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. An ultracentrifuge rotor comprising:

a body portion; and a plurality of nested rings of filament windings surrounding said body portion for strengthening and stiffening same.

2. An ultracentrifuge rotor according to claim 1 wherein said windings are of high strength, high modulus fibers.

3. An ultracentrifuge rotor according to claim 2 wherein said fibers are made from boron.

4. An ultracentrifuge rotor according to claim 2 wherein said fibers are made from carbon.

5. An ultracentrifuge rotor according to claim 2 wherein each of said rings has less than fifteen layers of fibers.

6. An ultracentrifuge rotor according to claim 2 wherein said fibers are coated with a polymer and encased in an epoxy matrix.

7. An ultracentrifuge rotor according to claim 1 wherein said body is formed as a bowl with a central open chamber defined by a thin, cylindrical wall extending from a supporting base, said rings surrounding said cylindrical wall.

8. An ultracentrifuge rotor according to claim 7 wherein said body is solid and made from metal.

9. An ultracentrifuge rotor according to claim 8 wherein said body metal is a titanium alloy.

10. A method for fabricating an ultracentrifuge rotor comprising the steps of:

providing a body portion; and surrounding said body portion with a plurality of thin, nested rings of wound fibers.

11. A method according to claim 10 further comprising the step of:

individually winding said rings on mandrels having different diameters.

12. A method according to claim 11 wherein the diameters of said mandrels are chosen so that each ring of fibers will have less than fifteen layers of windings and so that said rings may be nested together into one ring of high filament density.

13. A method according to claim 10 wherein the step of surrounding said body portion comprises the steps of:

coating each of said rings with a thin coat of epoxy; and lightly pressing said rings onto each other using very small axial loading pressures.

14. A method according to claim 13 further comprising the step of curing said nested rings to permit said epoxy to harden.

15. A reinforced ultracentrifuge rotor comprising:

a titanium bowl element; and a plurality of turns of a filamentary material having a lower density, higher modulus of elasticity and higher tensile strength than titanium, secured around the periphery of said rotor element, whereby the maximum rate of rotation of said rotor is substantially increased.

16. A reinforced centrifuge rotor as in claim 15, wherein said filamentary material comprises a boron filament.

17. A reinforced centrifuge rotor as in claim 15, wherein said filamentary material is preformed in the shape of a sleeve and telescoped over the periphery of said annular rotor element.

18. A reinforced centrifuge rotor as in claim 15, wherein said filamentary material is formed from a plurality of preformed sleeves of multi-layers of filamentary material, each being formed from a single run of material and telescoped over one another and over the outer periphery of said rotor element.

19. A reinforced centrifuge rotor as in claim 15, wherein said annular rotor element has an annular groove formed in the outer periphery thereof and, wherein said filamentary material is positioned around the periphery of said rotor element in said annular groove.

* * * * *